United States Patent [19]

Goto

[11] 4,096,405

[45] Jun. 20, 1978

[54] ELONGATED ELECTRIC INCANDESCENT LAMP

[75] Inventor: Eizo Goto, Chigasakishi, Japan

[73] Assignee: Tokyo Shibaura Electric Company, Limited, Japan

[21] Appl. No.: 773,289

[22] Filed: Mar. 1, 1977

[30] Foreign Application Priority Data

Mar. 1, 1976 Japan ..... 51-22015
Apr. 30, 1976 Japan ..... 51-49712

[51] Int. Cl.[2] ..... H01K 1/50

[52] U.S. Cl. ..... 313/174; 313/176; 313/222; 313/213; 313/274

[58] Field of Search ..... 313/222, 174, 176, 178

[56] References Cited

U.S. PATENT DOCUMENTS 3,644,773 2/1972 Coaton et al. ..... 313/174

*Primary Examiner*—Rudolph V. Rolinec
*Assistant Examiner*—Darwin R. Hostetter
*Attorney, Agent, or Firm*—Oblon, Fisher, Spivak, McClelland & Maier

[57] ABSTRACT

An elongated electric incandescent lamp having a closed envelope the inner diameter of which is less than 16mm and which is filled with an inert gas, a plurality of filaments suspended within the envelope and a getter disposed in the vicinity of each of the filaments.

3 Claims, 3 Drawing Figures

ELONGATED ELECTRIC INCANDESCENT LAMP

BACKGROUND OF THE INVENTION

1. Field of the Invention

The present invention relates generally to an elongated electric incandescent lamp characterized by a plurality of filaments being spaced apart from each other by a suitable distance within a bulb which is pervious to light, and more particularly relates to such a lamp which is characterized by its ability to be disposed in any direction, and even in a vertical position, without blackening of the bulb occurring, by disposing a getter in the vicinity of the lamp filament.

2. Description of the Prior Art

There have been proposed and devised various types of elongated electric incandescent lamps wherein a single long filament is contained or suspended in the bulb. In one of these lamps, evacuation is required to avoid heat dissipation (so called "gas loss") and excessive increasing of the temperature of the bulb-top by the convection of a filling gas. However, the lamp efficiency and lamp life are not satisfactory because of the low filament-color temperature.

Another elongated electric incandescent lamp having a single long filament disposed in a quartz bulb of which the diameter is less than 10mm, to avoid the gas loss, is already known. While this lamp has been improved, at least as to the problem of "gas loss", it still has the disadvantage, already described, as to gas convection, when the lamp is used while disposed vertically.

Still another elongated electric incandescent lamp having a single long filament disposed in a quartz bulb, such as a halogen lamp, which is often equipped in a copying machine, is also known. In the halogen lamp, the filament is generally designed so as to provide a uniform illumination pattern on the copying paper by terminating several parts thereof. At the terminating parts, or unlighted places, due to the low temperature, the so called "halogen cycle" is disturbed and bulb-blackening arises.

SUMMARY OF THE INVENTION

Accordingly, it is an object of the present invention to provide an improved elongated electric incandescent lamp of the type in which a plurality of filaments are spaced apart from each other by a suitable distance within a bulb containing an inert filling gas.

It is another object of the present invention to provide an improved elongated electric incandescent lamp characterized by high efficiency and long life.

It is still another object of the present invention to provide an elongated electric incandescent lamp having a bulb which contains an inert filling gas and a plurality of filaments and which has improved "gas loss" characteristics and which may be operated in a vertical position without encountering bulb blackening.

It is yet a further object of the present invention to provide a new method for washing a lamp bulb during the manufacture of an electric incandescent lamp.

BRIEF DESCRIPTION OF THE DRAWINGS

Various other objects, features and attendant advantages of the present invention will be more fully appreciated as the same becomes better understood from the following detailed description, when considered in connection with the accompanying drawings, wherein like reference characters designate like or corresponding parts throughout the several figures, and in which.

DETAILED DESCRIPTION OF THE PREFERRED EMBODIMENTS

Figure 1:
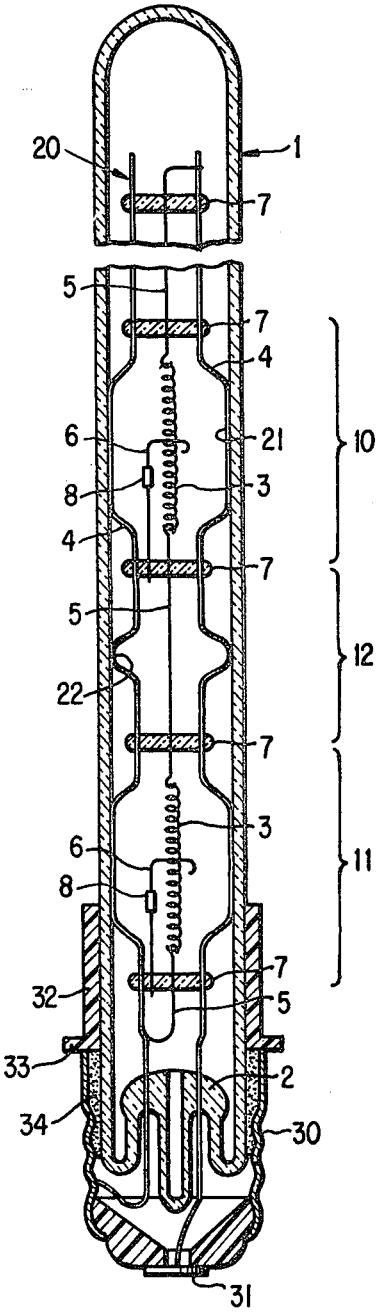
FIG. 1 is a schematic sectional view of an elongated electric incandescent lamp shown disposed in a vertical direction, and formed in accordance with the present invention.

Referring now to the drawings, and more particularly to FIG. 1 thereof, there is shown a tubular glass envelope 1 of a lamp bulb which is molded from a soft glass, such as soda lime glass, or semi-hard glass, such as borosilicate glass or aluminosillicate glass, has an inner diameter of less than 16mm, or preferably of 10–14mm, and is filled with an inert gas at 600mm Hg, such as argon, nitrogen, krypton or the like or a mixture thereof. A stem 2 is fitted in or sealed with the one end of the glass envelope 1. Enclosed within the glass envelope 1 is a filament-supporting assembly 20, which constitutes one of the major elements of the lamp bulb, having a plurality of light emitting elements or filaments 3 connected in series, and which comprises a pair of frame wires 4 which place the structure of the supporting assembly into contact with the inner wall surface of the glass envelope 1 so as to securely hold it in position, lead wires 5 which are electrically interconnected between and through the filaments 3 for suspending and supporting them and which also function as feeders, an anchor wire 6 for each filament 3 for supporting the filaments 3 at points intermediate their ends, and insulators 7, such as glass beads, disposed at each end of each of the filaments, for integrally holding the anchor wires 6, the frame wires 4, and the lead wires 5. Getters 8 are disposed on each of the anchor wires 6 and are prepared from at least one metal selected from a group consisting of zirconium, titanium, thorium, niobium, tantalum and ceto (trade name). Those metal powders are fully mixed in specified proportions, using a binder consisting of, for example, nitrocellulose. The mixture is suspended in an organic solvent consisting of, for example, butyl acetate. The suspension is applied or coated on the suitable portion of the anchor wires 6. Thus, the getters 8 are easily disposed. Since the solvent is dried off and the binder is completely expelled during the operation of evacuating the lamp envelope 1, the getter 8 is in no way obstructed in performing a gettering action.

In the illustrated embodiment, only two filaments are shown, but it is apparent that more than two filaments may be provided and that, depending upon the number of filaments, the number of lead wires and glass beads of the filaments, as supporting assembly 20, may be varied. The frame wires 4 and lead wires 5 are, for example, nickel wires or nickel iron wires. The glass beads 7 are spaced apart by a predetermined distance and serve to electrically isolate the frame wires 4, lead wires 5 and anchor wires 6, which are extended in parallel relation with each other in a common plane.

The filament-supporting assembly 20 consists of filament supporting sections 10 and 11, at which the filaments 3 are supported, and a filament non-supporting section 12, these sections being alternately located. In the filament supporting sections 10 and 11 of the assembly 20, the frame wires 4 are bent outwardly to form expanded sections 21 which are in opposed relation with the filaments 3. In the filament non-supporting section 12 of the assembly 20, the center portions of the frame wires 4 are bent to form projected sections 22.

The expanded sections 21 of the filament supporting sections 10 and 11 and the projected sections 22 of the filament non-supporting section 12 are brought into resilient contact with the inner wall of the glass envelope 1 and the whole of the filament-supporting assembly 20 of the supporting sections 10, 11 and 12 is held in place by the reaction forces of the expanded sections 21 and projected sections 22.

The lead wires 5 are mounted substantially at the center of the glass beads 7, so as to be placed generally along the axis of the glass envelope 1, and have their ends located in the filament-supporting sections 10 and 11, respectively. Between adjacent lead wires 5 are extended the filaments 3, so as to be electrically connected to each other. The anchor wires 6 have their one ends securely fixed to the glass beads 7, respectively, and have their other ends extended to points midway along the filament supporting sections 10 and 11, respectively, being bent there at substantially right angles and wound around the filaments 3, respectively, thereby suspending them.

The frame wires 4 are extended from the inside of the glass envelope 1, which is sealed with the stem 2, the one frame wire being connected electrically to a main body of a base 30, whereas the other frame wire is connected to an eyelet terminal 31 of the base 30.

Along the one end of the bulb wall, a cylindrical holder or insulator 32 having a flange portion 33 is provided for easily and safely holding the lamp bulb. The flange portion 33 functions as a stopper which extends outwardly to cease the screwing of the base 30, and it also functions as an electrical protector for preventing the fingers from touching the base 30. The reference numeral 34 indicates cement for fixing the base 30 with the bulb envelope 2. To attain the high efficiency and non-blackening characteristic of the elongated electric incandescent lamp, the following washing step carried out during the manufacturing of the lamp is quite effective.

Figure 2:
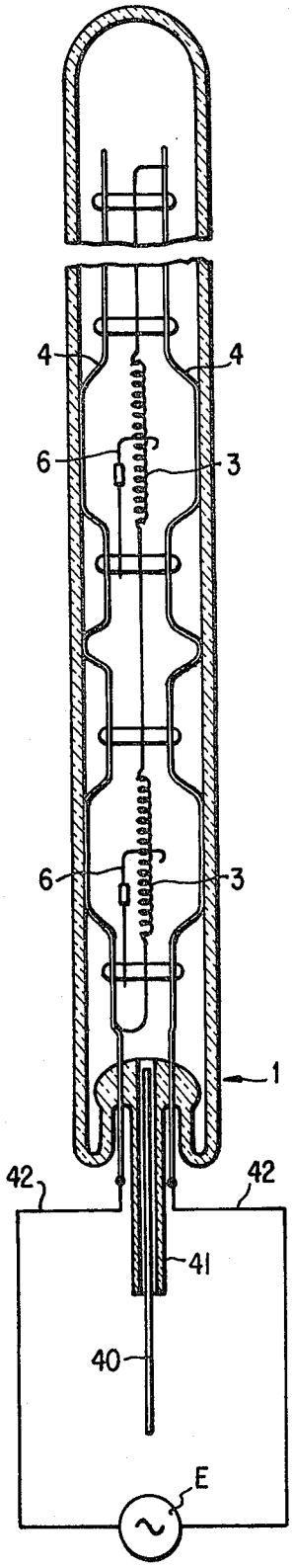
FIG. 2 is a schematic sectional view of a lamp which illustrates the washing method of the bulb, in accordance with the present invention.

Firstly, referring to FIG. 2, an elongated tube 40, which communicates with the envelope 1, is loosely inserted in an exhaust tube 41 thereof for introducing or filling the bulb with a forming gas consisting of a mixture of hydrogen and an inert gas, such as 25% hydrogen and 75% nitrogen.

After introducing or filling the forming gas within the envelope 1, a voltage is applied between lead wires 42, being the ends of frame wires 4, to heat and maintain the filament-color-temperature at 2900° K for 30 seconds. By this operation, impure gas absorbed in the getters 6, the filaments 3 and the frame wires 4 is carried out through the clearance between the elongated tube 40 and the exhaust tube 41 with the over-flow forming gas.

As a result, the envelope 1, which is filled with the forming gas, is cleaned or washed.

The exhausting step and the sealing step are carried out in the same manner as in conventional lamp manufacturing methods.

Unlike the washing step mentioned above, it is more preferable to wash the bulb efficiently in a special container, not shown, in which gas convection is less disturbed rather than those of small diameter.

Figure 3:
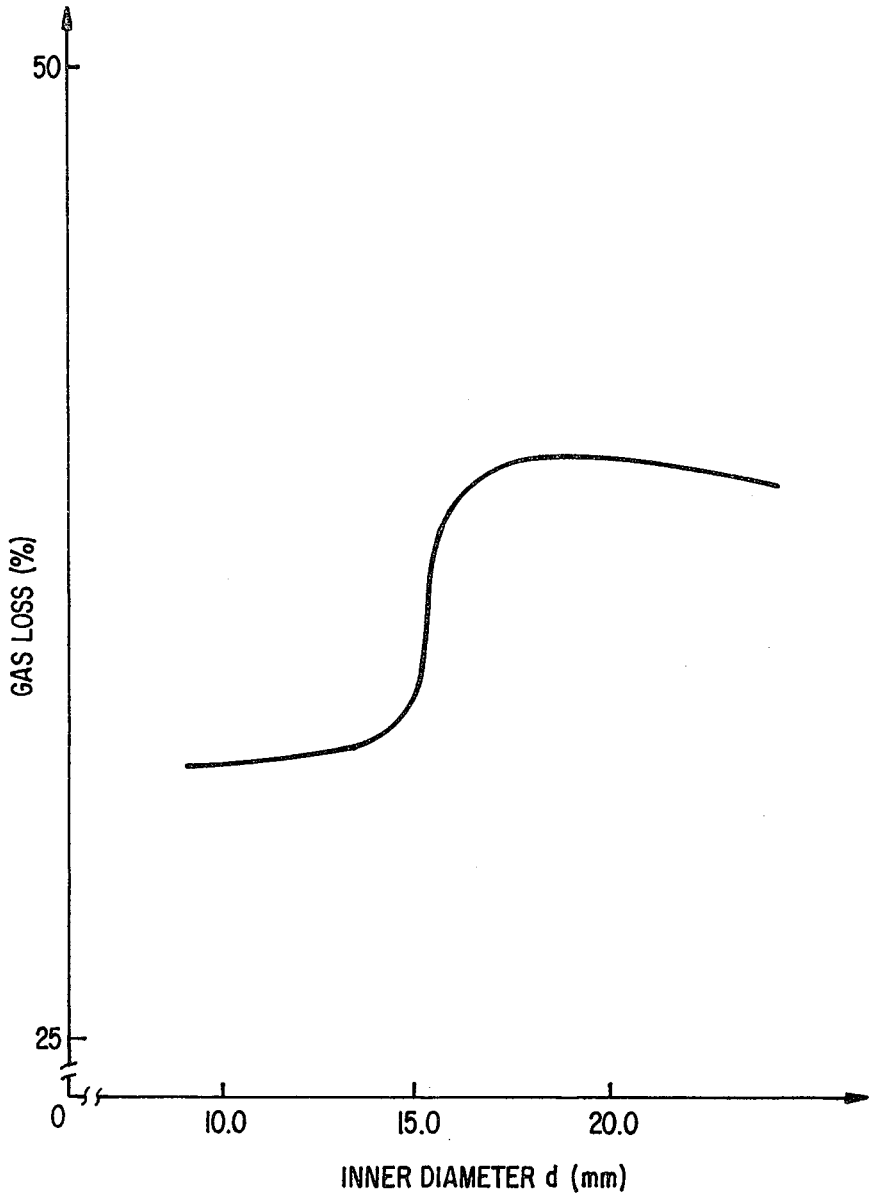
FIG. 3 is a graph showing the relationship between "gas loss" and the bulb inner diameter.

As clearly illustrated in FIG. 3, there is disclosed the reason the elongated lamp envelope with an inner diameter less than 16mm is excellent, which is experimentally observed. It is understood that the gas loss increases abruptly when the diameter of the bulb exceeds 16mm. A bulb having a diameter less than 10mm is not recommended, because of the short distance between the bulb wall and the filaments, which causes bulb cracking by the heat radiation.

In the embodiment of the invention mentioned above, the suspension is applied or coated on the anchor wire, however, it may be done by attaching a piece of metal zirconium, titanium, thorium, niobium and tantalum or the like on the anchor wire.

Table 1 shows the optimum-functioning temperatures of various kinds of getters. These may be selectively used according to the bulb dimensions or the filling gas or the operational conditions of the lamp.

| Kinds of getter | Exhausting temperature (° C) | Optimum functioning temperature (° C) |
|---|---|---|
| Zirconium | 700 ~ 1300 | 100 ~ 1200 |
| Tantalum | 1600 ~ 2000 | 500 ~ 1200 |
| Niobrium | 1650 ~ | 400 ~ 900 |
| Titanium | 1000 ~ 1300 | 500 ~ 1200 |
| Thorium | 800 ~ 1300 | 400 ~ 500 |
| Ceto (trade name) | 800 ~ 1200 | 200 ~ 500 |

According to the above described construction of a lamp having a plurality of filaments and a getter disposed in the vicinity of the filament in a bulb having a diameter of less than 16mm, the hot zone and cool zone are alternatively developed in the bulb and upward movement of the hot gas is disturbed by the cool zone, thus inert filling gas convection is efficiently suppressed.

In addition, despite the suppressing of the gas convection, residual impurity gas released from the filaments and frame wires can be effectively absorbed by each of the getters disposed in the vicinity of the filaments.

Obviously many modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the U.S. is:

1. An elongated electric incandescent lamp comprising:
   - an envelope having an inner diameter of less than 16 mm containing an inert filling gas;
   - a plurality of filaments arranged serially in the envelope; and
   - a plurality of getters, one getter disposed in the vicinity of each filament, to permit operation in any position without envelope blackening.

2. An elongated electric incandescent lamp according to claim 1 further comprising a supporting member for the filaments having anchor wires which support the filaments; and wherein one getter is disposed on each of the anchor wires.

3. An elongated electric incandescant lamp according to claim 2 wherein the plurality of filaments are discontinuously suspended by the supporting member.

* * * * *